United States Patent [19]

Bialkowski

[11] 4,127,755

[45] Nov. 28, 1978

[54] VACUUM SWITCH TUBE

[75] Inventor: Günter Bialkowski, Berlin, Germany

[73] Assignee: Siemens Aktiengesellschaft, Berlin & Munich, Germany

[21] Appl. No.: 710,877

[22] Filed: Aug. 2, 1976

[30] Foreign Application Priority Data

Aug. 5, 1975 [DE] Fed. Rep. of Germany ..... 2534954

[51] Int. Cl.[2] ..... H01H 33/66
[52] U.S. Cl. ..... 200/144 B
[58] Field of Search ..... 200/144 B

[56] References Cited

FOREIGN PATENT DOCUMENTS 1,093,231 11/1967 United Kingdom ..... 200/144 B

*Primary Examiner*—Robert S. Macon
*Attorney, Agent, or Firm*—Hill, Gross, Simpson, Van Santen, Steadman, Chiara & Simpson

[57] ABSTRACT

In a vacuum switch tube having an outer insulating member and a metallic protective screen surrounding internal switch contacts, an inner groove is provided within the insulator member to which is attached a ring-shaped mounting. A central portion of the protective screen has a protrusion in the shape of a circumferential corrugation or nub via which the screen attaches to the ring-shaped mounting.

2 Claims, 2 Drawing Figures

VACUUM SWITCH TUBE

BACKGROUND OF THE INVENTION

1. Field of the Invention

This invention relates to a vacuum switch tube and more particularly to a vacuum switch tube having an internal hollow cylindrical metallic protection screen surrounding internal switch contacts.

2. Description of the Prior Art

It is known to provide a vacuum switch tube with a hollow cylinder insulating member which is vacuum sealed at the end by metallic flanges carrying contacts for the switch tube. A cylindrical insulator member is provided with a circumferential inner groove at a center portion wherein a ring-shaped metallic mounting may be arranged to carry a hollow cylinder metallic protection screen which is spaced from the inner insulating member wall and surrounds the switch contacts concentrically.

Such a vacuum switch tube is known from the U.S. Pat. No. 3,857,005 (German Offenlegungsschrift No. 2,058,020). This publication, however, provides no teaching as to an appropriate arrangement and mounting of the metallic protection screen within the vacuum switch tube interior.

It is also known in the art such as from German Letters Pat. No. 1,267,305 (U.S. Patent Application Ser. No. 424,600) to mount the mounting ring of the vapor screen by way of hard soldering between a divided ceramic cylinder or by way of a welding method applied between two metal flanges attached by way of glazing (see German Auslegeschrift No. 1,245,472). Finally it is also known from U.S. Pat. No. 3,283,103 (German Auslegeschrift No. 1,273,661) to protect the insulating inner surfaces of the vacuum tight switch housing from the precipitation of metal particles produced by the light arc by use of a tubular metal screen. The screen catches the metal vapors emanating from the light arc during switching processes and condenses them before they reach the wall of the housing thereby preventing any degradation of the insulating effects of the walls. Again, however, this publication does not make any explicit statements concerning the attachment of the metal screen. It merely states that the metal screen is mounted to the housing in a suitable manner.

SUMMARY OF THE INVENTION

It is an object of the present invention to provide a simple and cheap attachment of a vapor screen within the insulating member of a vacuum switch tube. With the method and apparatus of this invention, a protective screen is provided which has a protrusion at a central portion in the form of a circumferential groove or nub which serves to mount the protective screen at the ring-shaped mounting on the insulator wall.

The ring-shaped mounting preferably consists of two segment-shaped punched parts. The segments have a shape adapted to be easily inserted into the inner groove of the insulating member and has dimensions which are adapted to fit with the inner diameter of the groove of the insulating member. For hard soldering processes, dimensions of the mounting segment are such that their diameters are adapted to the different heat expansion coefficients of the materials used.

The vacuum switch tube is preferably produced such that two segment-shaped parts are inserted into the inner groove of the hollow cylinder ceramic insulator member. The protective screen having the protrusion is suspended at the segment-shaped punched parts along with a solder ring or solder foil. The soldering is effected simultaneously with the soldering of the flanges to the insulating member. It may therefore also be advantageous to solder together the segment-shaped punched parts at the same time to a metal insulation applied within the inner groove of the ceramic insulator member.

The vacuum switch tube in accordance with the invention has the important advantage that it can be produced easily and cheaply. For instance, the protective screen centers itself due to the frustum shaped corrugation or nub surface of the protrusion during a suspension process.

DESCRIPTION OF THE PREFERRED EMBODIMENTS

Figure 1:
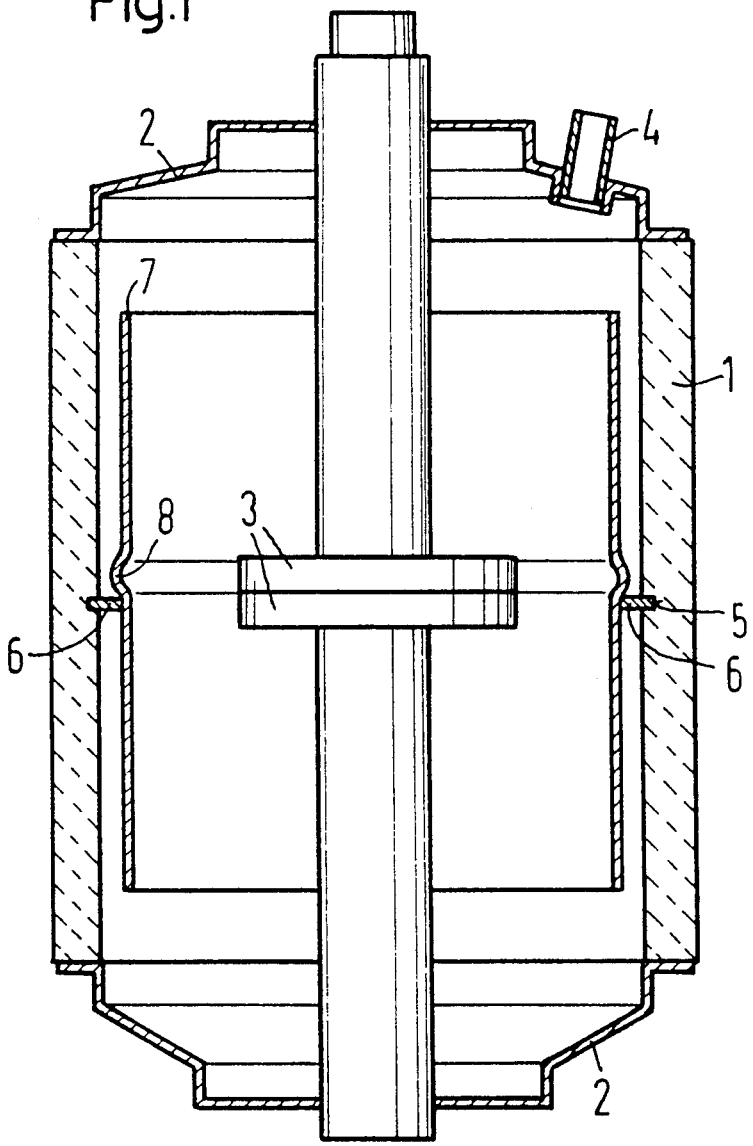
FIG. 1 is a cross-sectional view of a vacuum switch tube of this invention.
Figure 2:
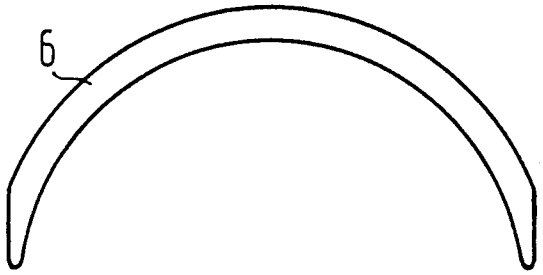
FIG. 2 is a plan view of one of the segment-shaped punched parts used for mounting the protective screen within the vacuum switch tube.

The vacuum switch tube of FIG. 1 essentially consists of a hollow cylinder insulating member 1 preferably constructed of ceramic. The insulator member 1 is vacuum sealed at its ends by way of metallic flanges 2 which are soldered to the insulator member. The flanges carry two switch contacts 3, one of which is fixed and the other of which is movable. The movable switch contact, in the case of certain embodiments, may be vacuum sealed by a springy metal bellows which may be arranged within or outside of the housing (not shown in the drawings). The flanges 2 may, for instance, have the shape of caps or plates. To allow for the coefficient of expansion of the flanges 2, it may also be advantageous to interpose a further flange ring between the insulator member 1 and the flanges 2. In one of the flanges 1, an exhaust tube 4 is provided for evacuating the housing. The insulator member 1 is provided with a circumferential inner groove 5 at a central portion. A ring-shaped metallic mounting 6 is arranged within this groove. The mounting 6 preferably consists of two segment-shaped punched parts, one of which is shown in a plan view in FIG. 2. The ring-shaped metallic mounting 6 carries a hollow cylinder protective screen 7 spaced from the inner wall of the insulator member 1. This metallic protective screen 7 has a protrusion 8 at a central portion in the shape of a circumferential bulge, groove, or nub via which the protective screen 7 is attached to the ring-shaped mounting 6. The attachment may be advantageously effected in one soldering process by simultaneously soldering the flanges 2 to the insulator member 1, the exhaust lead 4 to one of the flanges 2, and the segment-shaped punched parts of the mounting 6. For this purpose, the protective screen 7 with the protrusion 8 is suspended onto the mounting 6 while providing a solder ring or solder foil. The protective screen 7 centers itself when suspended on the mounting 6. Furthermore, the frontal side of the insulator member 1 and the exhaust tube 4 are provided with a solder ring or solder foil and the groove 5 with metallization. Then, the soldering of the flanges 2 with the insulator member 1, the exhaust tube 4 with a flange 2, the protrusion 8 of the protection screen 7, and the segment-shaped punched portions of the mounting 6 may occur simultaneously in one process.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. In a vacuum switch tube with a hollow cylinder insulator member which is vacuum sealed at the ends by metallic flanges carrying switch contacts and which is provided with a circumferential inner groove at a central portion within which a ring-shaped metallic mounting is arranged, said mounting carrying a hollow cylindrical metallic protective screen which is spaced from the inner insulator member walls, the protective screen surrounding the switch contacts concentrically, wherein the improvement comprises a curved protrusion integrally formed from and at a central portion of the protective screen in the form of a circumferential ridge via which the protective screen is attached to the ring-shaped mounting; and said ring-shaped metallic mounting comprising two segment-shaped punched parts.

2. A vacuum switch tube comprising:

(a) a hollow cylinder insulator member vacuum sealed at the ends by metallic flanges carrying switch contacts;

(b) a circumferential inner groove at a central portion of the insulator member;

(c) a ring-shaped metallic mounting within said groove; and (d) a hollow cylindrical protective screen within said insulator member and surrounding said contacts, the screen having a curve-like cone-shaped circumferential outwardly extending ridge integrally formed from the screen and in circular, soldered and resting contact with said metallic mounting, said ridge being in a position directly above said metallic mounting and a lower portion of the ridge in resting abutment with an outer edge of the ring-shaped metallic mounting.

* * * * *